US005934815A

United States Patent [19]

Hurlburt

[11] Patent Number: 5,934,815

[45] Date of Patent: Aug. 10, 1999

[54] COSMETIC CONTAINER HAVING SPRING BIASED COSMETIC CARRIER

[75] Inventor: David R. Hurlburt, West Cornwall, Conn.

[73] Assignee: Rexam Cosmetic Packaging Inc., Torrington, Conn.

[21] Appl. No.: 08/888,979

[22] Filed: Jul. 7, 1997

[51] Int. Cl.[6] ..... A45D 40/10; B43K 21/08

[52] U.S. Cl. ..... 401/81; 401/59; 401/75; 401/77; 401/78

[58] Field of Search ..... 401/75, 76, 77, 401/78, 59, 81

[56] References Cited

U.S. PATENT DOCUMENTS

| | | | |
|---|---|---|---|
| 1,216,070 | 2/1917 | Carlson | 401/81 |
| 1,849,531 | 3/1932 | Lyhne | 401/78 |
| 1,953,910 | 4/1934 | Parkin . | |
| 2,486,073 | 10/1949 | Sommer . | |
| 2,486,960 | 11/1949 | Mesh et al. | 401/81 |
| 2,491,722 | 12/1949 | Gelardin | 401/81 |
| 2,626,048 | 1/1953 | Rosen | 401/61 |
| 2,630,215 | 3/1953 | Lynn . | |
| 2,655,261 | 10/1953 | Clark . | |
| 2,858,015 | 10/1958 | Grisel | 401/78 |
| 2,864,494 | 12/1958 | Wahle | 401/78 |
| 3,771,881 | 11/1973 | Swenson . | |
| 4,991,987 | 2/1991 | Holloway et al. | 401/78 |
| 5,102,249 | 4/1992 | Holloway et al. . | |

FOREIGN PATENT DOCUMENTS 852033 of 0000 United Kingdom .

*Primary Examiner*—Henry J. Recla
*Assistant Examiner*—Tuan Nguyen
*Attorney, Agent, or Firm*—Alston & Bird LLP

[57] ABSTRACT

A cosmetic container, such as for lipstick, having an upwardly biased cosmetic carrier for creating torque. A biasing member such as a spring is provided and is secured, according to one embodiment, at its bottom end to the bottom portion of the inner sleeve and at its upper end to the cosmetic carrier. According to an alternative embodiment an inner sleeve is unnecessary and a base is provided. The spring is connected at its lower end to the base and at its upper end to the cosmetic carrier.

8 Claims, 3 Drawing Sheets

COSMETIC CONTAINER HAVING SPRING BIASED COSMETIC CARRIER

FIELD OF THE INVENTION

The present invention is directed to a cosmetic container, such as a lipstick container, having a spring biased cosmetic carrier for creating the desired amount of torque when the container is manipulated.

BACKGROUND OF THE INVENTION

Quality cosmetics, such as lipsticks, are sold in quality containers. From a consumer's view, a high quality lipstick container has a certain "feel" to it, i.e., rotating freely due to its relatively low swivel torque but having enough resistance or torque to feel sturdy. It is within this range of preferred torque which cosmetic companies strive to achieve when crafting cosmetic containers.

Conventional lipstick containers include a cosmetic carrier, a tubular inner sleeve, a tubular outer sleeve and a decorative sleeve. The cosmetic carrier supports the lipstick and is generally configured as a sleeve having radially extending lugs on opposing sides and is received within the inner sleeve. The inner sleeve defines longitudinally extending channels on opposing sides wherein the lugs of the cosmetic carrier extend therethrough. An outer sleeve defining a continuous helical channel is positioned about the inner sleeve wherein the lugs of the cosmetic carrier are configured to be received and to traverse along the length of the helical channel. This results in the cosmetic carrier being moved upwardly as the lugs traverse the length of the helical channel when a bottom portion of the inner sleeve is rotated. The decorative outermost sleeve is provided for aesthetic purposes. In operation, a bottom portion of the inner sleeve extends beyond the bottom of the outer decorative sleeve. The user rotates the bottom portion to cause the cosmetic carrier and, hence, the lipstick to extend from the case for applying the lipstick and to retract into the case for storage.

If one of the above-mentioned conventional components of the lipstick container is eliminated, while still providing a functional container, economies are achieved. For instance, economies in manufacturing would result with one less component to be assembled. This, in turn, would reduce the customer's end cost.

Several cosmetic containers provide the requisite torque but do so in a manner which requires exact tolerance, are relatively expensive to manufacture, and experience wear over extended use thereby adversely effecting torque produced between the relatively rotating sleeves. Further, many have features directed to achieving the desired amount of torque, but none achieve the desired torque consistently or while eliminating one of the conventional components.

For example, U.S. Pat. No. 1,953,910 to Parkin (hereinafter the '910 patent) is directed to a lipstick container including an outer sleeve defining a spiral slot and an inner sleeve defining a longitudinally extending slot. A cosmetic carrier is positioned within the inner sleeve and includes a pin which extends through the axial slot and into the spiral slot as is conventional. Positioned beneath the cosmetic carrier is a coil spring which bears against the bottom of the cosmetic carrier for providing tension so as to facilitate the projection of the inner sleeve. The '910 patent indicates that the spring merely "bears" against the cosmetic carrier and is not secured thereto to prevent rotation of the spring relative to the tubular sleeves of the container. Thus, an inner sleeve is required to restrict rotational movement of the cosmetic carrier relative to the outer sleeve.

SUMMARY OF THE INVENTION

It is therefore an object of the present invention to provide a lipstick container which achieves the desired amount of torque between the members of the container.

It is also an object of the present invention to provide the desired amount of torque with a design which is effective, can withstand extended use, and is easy to manufacture.

It is a further object of the present invention to provide a lipstick container which, according to one embodiment, eliminates the need of an inner sleeve.

The cosmetic container according to the present invention overcomes the drawbacks and shortcomings of the prior art by providing a cosmetic container having the desired amount of torque due, at least in part to a biasing member for biasing the cosmetic carrier longitudinally upward. According to a first embodiment, a spring is positioned beneath the cosmetic carrier and the inner sleeve to bias the inner sleeve and the cosmetic carrier axially upward. The upper end of the spring is secured to the cosmetic carrier and the lower end is secured to the inner sleeve. The inner sleeve and the spring maintain the cosmetic carrier in alignment to prevent relative rotational movement therebetween. The bias of the cosmetic carrier is limited by the carrier's lug which extends through the longitudinal slot of the inner sleeve and within the helical channel of the spiral sleeve. In use, the base of the inner sleeve is rotated relative to the outer sleeve causing the lug to ascend or descend within the helical channel under the influence of the spring to produce the requisite torque.

According to a second embodiment of the invention, the inner sleeve is eliminated. A base is provided which extends coaxially around the outer sleeve. The cosmetic carrier is concentrically positioned within and directly adjacent the outer sleeve. The spring is positioned beneath the cosmetic carrier and is fixed thereto at its upper end. The spring is mounted at its lower end to a bottom portion of the base wherein the base is rotated by the user for the extension or retraction of the cosmetic within the container. Accordingly, the spring prevents the cosmetic carrier from rotating relative to the base, thereby eliminating the need for an inner sleeve.

More specifically, the outer sleeve includes an outwardly extending protrusion which is received within a corresponding recess defined by an upper portion of the base. A collar is provided to maintain proper alignment of the base and the outer sleeve. Conventionally, the inner sleeve is integral with the base such that when the user rotates the base, the inner sleeve and the cosmetic carrier rotate relative to the outer sleeve. According to this embodiment, rotational movement of the cosmetic carrier relative to the base is prohibited due to the integral connection of the spring at its upper end to the bottom of the cosmetic carrier and at its lower end to a bottom portion of the base. However, relative rotational movement is permitted between the spiral sleeve and the cosmetic carrier. Thus, similar to the first embodiment, the spring aids in achieving the desired torque.

DETAILED DESCRIPTION

Figure 1:
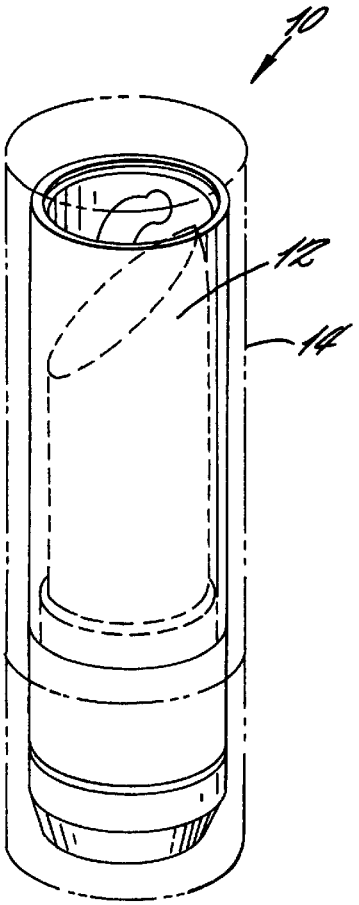
FIG. 1 is a perspective view of a lipstick container according to the present invention.

The present invention will now be described more fully in detail with reference to the accompanying drawings, in which a preferred embodiment of the invention are shown. This invention should not, however, be construed as limited to the embodiments set forth herein; rather, they are provided so that this disclosure will be thorough and complete and will fully convey the scope of the invention to those skilled in the art.

The present invention is shown and described herein as a container for applying cosmetics, such as lipstick. For the sake of brevity, the description which follows will refer to a lipstick container. However, it should be evident that the container has utility in various other areas wherein a product is to be extended from and retracted into a case. For instance, the container may be utilized for any product requiring topical application.

The lipstick container of the present invention, indicated by the reference character 10, is designed for dispensing lipstick 12, shown in phantom, so that it may be cosmetically applied. An outer enclosure 14, shown in phantom, may also be provided as a protective outer enclosure for the lipstick container 10. The lipstick container 10 includes a plurality of tubular members which are concentrically arranged about the longitudinal axis. The lipstick 12 is positioned within a cosmetic carrier 16 to secure the lipstick therein. The cosmetic carrier 16 includes a base 18 and a cylindrical sidewall 20 extending upwardly from the base 18 to define a cup for receiving and holding the lipstick 12. The cosmetic carrier 16 also includes a pair of lugs 22 positioned on diametrically opposing outer surfaces of the cylindrical sidewall 20. Although the lugs 22, as shown, are provided as a pair and are diametrically opposed, it would not be a departure from the scope of the present invention to provide one or any number of lugs in any location along the outer surface of the cosmetic carrier 16. A biasing member 24 is associated with a bottom surface of the cosmetic carrier 16 as explained more fully in detail below.

Figure 2:
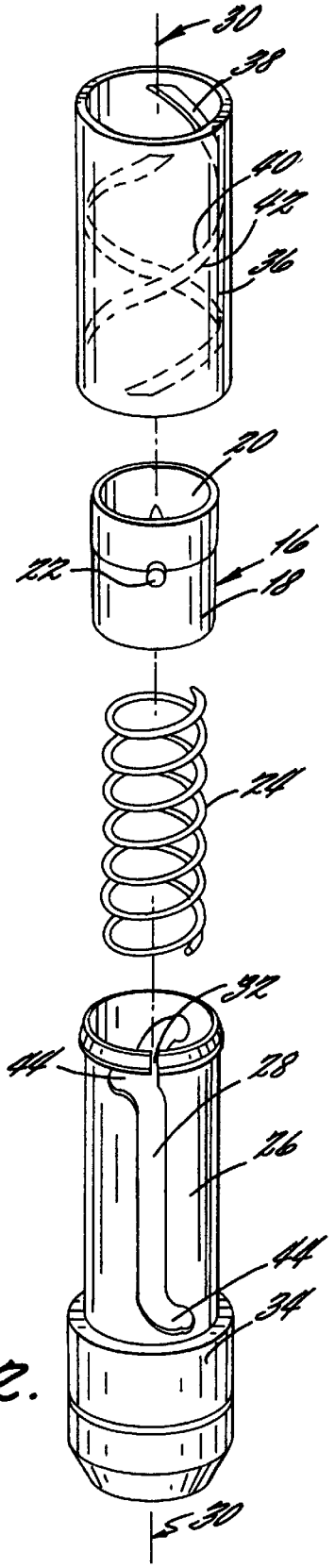
FIG. 2 is an exploded view of a first embodiment of the present invention.
Figure 3:
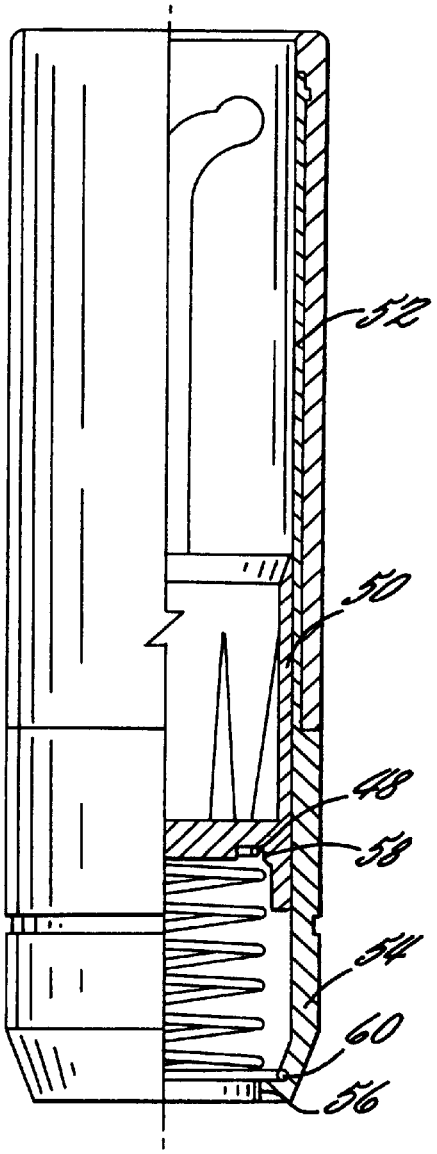
FIG. 3 is a partial cross-sectional view thereof shown in a retracted position.
Figure 4:
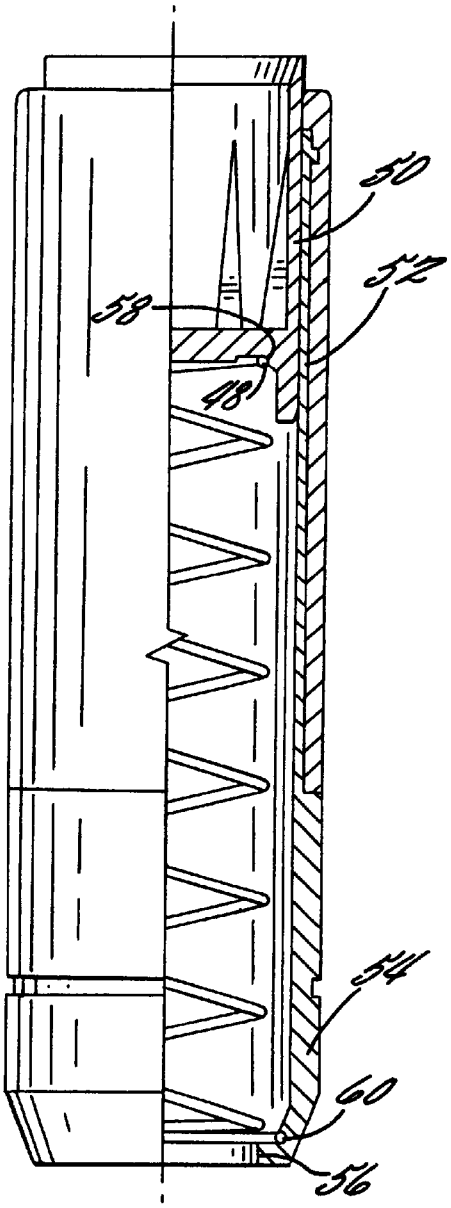
FIG. 4 is a partial cross-sectional view thereof shown in an extended position.

According to a first embodiment of the present invention, the cosmetic carrier 16 is positioned within a tubular inner sleeve 26, as best shown in FIGS. 2, 3 and 4. The tubular inner sleeve 26 includes, on opposing sidewalls, a pair of longitudinal slots 28 which extend parallel to the longitudinal axis 30. Positioning of the cosmetic carrier 16 is enhanced by an integral opening 32 provided along an upper edge of the tubular inner sleeve 26. Once positioned within the tubular inner sleeve 26, the cosmetic carrier 16 is movable longitudinally upwardly or downwardly within the inner sleeve 26. The longitudinal slots 28 permit the lugs 22 of the cosmetic carrier 16 to extend therethrough. At its lower end, the tubular inner sleeve comprises a manually rotatable grasping member 54 which will be discussed more fully below.

The inner sleeve 26 according to the first embodiment of the present invention is preferably molded of a resilient material, such as plastic. The inner sleeve 26 is defined substantially by a relatively thin walled tubular upper portion 52 having the longitudinal slots 28 formed therein and a thicker walled bottom portion 54 which is formed integrally with the lower end of the tubular portion 52. As best illustrated in FIG. 3, the bottom portion 54 extends a distance below the outer sleeve 36 so as to present a manually rotatable portion. Thus, the user may rotate the bottom portion 54 to provide relative rotational movement between the inner sleeve 26 and the outer sleeve 36 so that the cosmetic carrier 16 may be extended or retracted to apply the lipstick 12.

A tubular outer sleeve 36 is positioned circumferentially around the tubular inner sleeve 26. The outer sleeve 36 has a pair of opposed helical channels 38 formed on the inner surface thereof. The helical channels 38 are defined by opposing upper 40 and lower 42 sidewalls and are configured to receive at least a portion of the lugs 22 as shown in the various figures.

As best illustrated in FIGS. 3 and 4, a biasing member 24 is connected at its upper or proximal end to the cosmetic carrier 16. Preferably, the biasing member is in the form of a helical spring 24 for urging the cosmetic carrier upward within the cosmetic container 10. The cosmetic carrier 16 includes a bottom 48 and cylindrical sidewalls 50 extending upwardly from the bottom 48 to define a cup for receiving and holding a cosmetic. The proximal end of the biasing member or spring 24 is connected to an underside of the bottom 48 of the carrier 16 for urging the cosmetic carrier upward.

A seat 58 is defined by the bottom 48 of the carrier 16 for receiving the proximal end of the spring 24. The seat 58, preferably, is a groove configured to receive upper end portions of the spring 24 to mechanically secure the spring to the carrier and prevent relative rotational movement between the upper end of the spring 24 and the carrier 16. The lower end of the biasing member or spring 24 is similarly secured to the bottom 56 of the bottom portion 54 of the inner sleeve 26. The bottom 56 provides a seat 60 for the lower end of the spring 24. Preferably, the seat 60 is defined by a groove configured to receive a portion of this spring 24 to mechanically secure the spring to the base 54 to prevent relative rotational movement between the bottom portion of the spring 24 and the inner sleeve 26.

Accordingly, the spring 24 connects the cosmetic carrier 16 to the bottom portion 54 of the inner sleeve 26. The spring 24 urges the cosmetic carrier upward wherein the lugs are urged against the upper side wall 40 defining the helical channel 38. This thereby provides resistance resulting in the desired torque when the cosmetic carrier 16 is extended for the application of the lipstick 12. Similarly, when the cosmetic carrier 16 is retracted such as by the rotation of the base 54 of the inner sleeve 26 by the user, the retraction of the cosmetic carrier is counter to the bias of the spring 24, thereby also creating the requisite torque.

Figure 5:
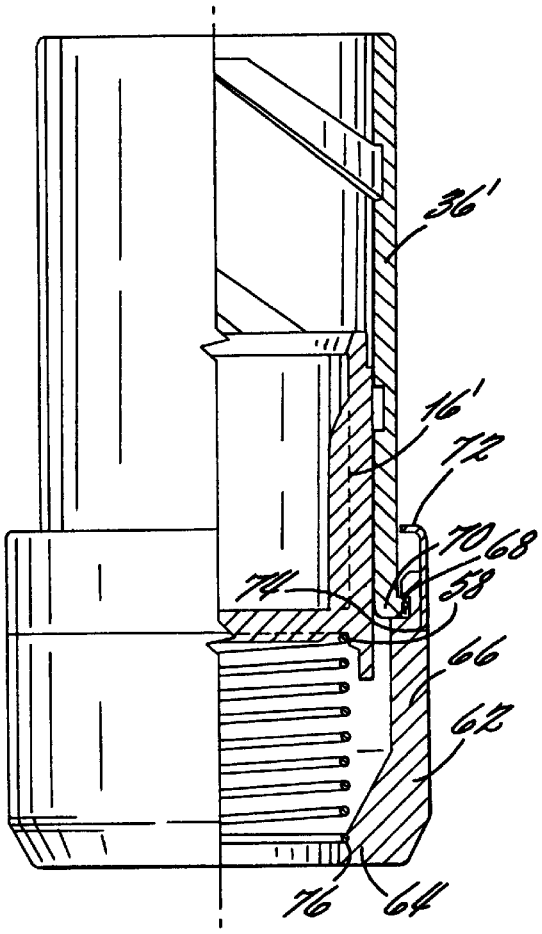
FIG. 5 is a partial cross-sectional view of a second embodiment of the present invention shown in a retracted position.
Figure 6:
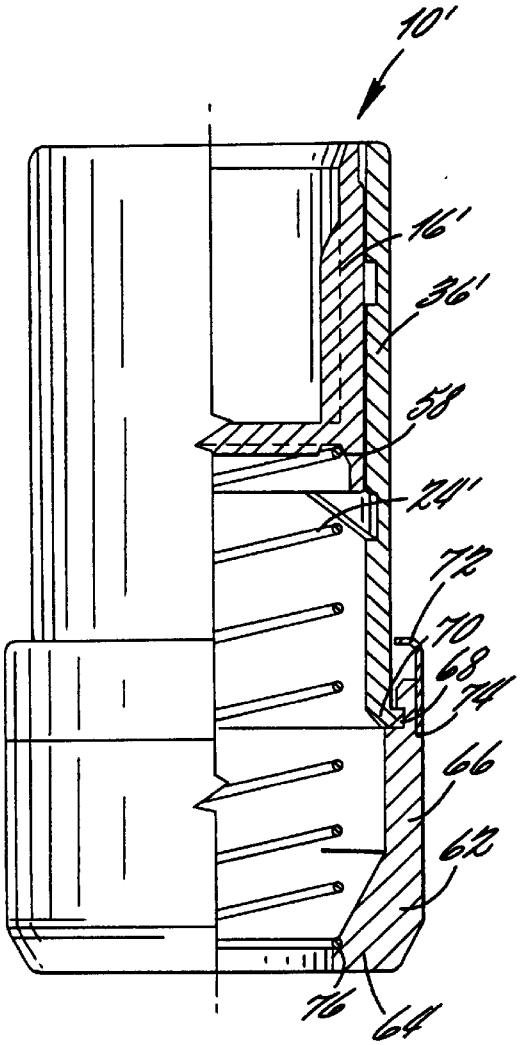
FIG. 6 is a partial cross-sectional view thereof shown in an extended position.

A second embodiment of the present invention is best illustrated in FIGS. 5 and 6. This embodiment is illustrated with like elements having the reference number as the first embodiment but with a prime (') designation. According to this embodiment, the inner sleeve is eliminated. Accordingly, the cosmetic carrier 16' is concentrically arranged and immediately adjacent the outer sleeve 36'. According to this embodiment, the lipstick container 10' includes a base 62 which provides a manually rotatable grasping member to be grasped by the user for retracting and extending the lipstick 12 within the lipstick container 10' for application. The base 62 is defined by a bottom 64 and cylindrical sidewalls 66 to define a cup for receiving the spring 24' and a portion of the cosmetic carrier 16'. The cylindrical sidewalls 66 include a circumferential channel 68 and the outer sleeve 36' defines a radially outwardly extending flange 70. The flange 70 is configured to be received within the circumferential channel 68 of the base 62 to interconnect the outer sleeve 36' with the base 62 while permitting relative rotational movement therebetween. A collar 72 is provided as an enclosure for the junction of the outer sleeve 36' and the base 62. Preferably, the collar 72 is friction fit about the base 62 and fits within a groove 74 defined by an outer upper end of the base 62.

Similar to the first embodiment, the biasing member or spring 24' sits within a seat defined, as illustrated, as a groove 74 which is configured to receive an upper end of the spring 24'. The bottom 64 of the base 62 also includes a seat 76 on its inwardly facing surface. The seat 76 preferably is defined by a groove configured to receive a bottom portion of the spring to mechanically secure the same. Accordingly, the upper end of the spring 24' is fixed to the bottom 56 of the cosmetic carrier 16 at its upper end, and at its lower end, to the bottom 64 of the base 62. Accordingly, relative rotational movement of this spring 24' relative to the cosmetic carrier 16 and relative to the base 62 is substantially prohibited.

The above described components of the cosmetic container 20 permit easy application of the lipstick by permitting the lipstick to be extended and retracted within the lipstick container 10. The cosmetic container 10 extends and retracts the lipstick 12 to permit extension thereof beyond the upper end of the cosmetic container 10 so that it may be applied. The lipstick 12 is propelled within and from the cosmetic container 10 by removal of the outer enclosure 14 and by the rotation of the bottom portion 54 according to the first embodiment or the base 62 according to the second embodiment 26. Rotating these members 54 or 62 in a predetermined direction causes the cosmetic carrier 16 retained therein to likewise rotate due to the extension of the lugs 22 through the longitudinal slots 28 which would, inherently, abut a respective longitudinal side edge defining the longitudinal slot 28 (depending upon the direction of rotation).

Because the lugs 22 are also received, or at least a portion thereof, within the helical channel 38, as the grasping member 34 of the inner sleeve 26 is rotated, the cosmetic carrier 16 traverses the length of the helical channel 38 of the outer sleeve 36 wherein it moves upward or downward within the longitudinal slot 28. At each end of the longitudinal slot 28 are provided laterally extending locking channels 44 which, as shown, are formed integrally with the longitudinal slot 28. The locking extensions 56 limit the upward movement of the cosmetic carrier 16 so that, when the cosmetic carrier 16 reaches the uppermost position, it is restrained from further upward movement as further rotatable movement of the grasping member 34 is prohibited. Likewise, at the bottom end, when the lipstick 12 within the cosmetic container 10 is fully retracted, further retraction is limited due to the retention of the lug within the laterally extending locking channel 44 of the longitudinal slot 28. Thus, the lipstick 12 may be extended by rotating the grasping members 62 or 54 in one direction, and retracted by rotating the grasping member 34 in the opposite direction to permit easy application while protecting the lipstick 12 within the container 10 when not in use.

As outlined above regarding the first embodiment, the inner sleeve defines longitudinal slots 28 through which the lugs 22 of the cosmetic carrier extend. The longitudinal slots 28 prevent relative rotational movement of the cosmetic carrier 16 relative to the inner sleeve 26 whereby rotation of the bottom portion 54 of the inner sleeve 26 causes the extension of the cosmetic carrier due, at least in part, to the lugs 22 traversing the length of the helical channel 38. According to the second embodiment of the present invention, the inner sleeve 26 may be eliminated because relative rotational movement of the cosmetic carrier 16 relative to the manually rotatable base 62 is substantially limited, if not prohibited, by the connection of the cosmetic carrier 16 to the base 62 via the biasing member 24. Similar to the first embodiment, the cosmetic carrier 16 of the second embodiment may also be extended or retracted within the lipstick container. The user may rotate the base 62 wherein the lugs 22 of the cosmetic carrier 16 traverse the length of the helical slots 38, and due to the biasing of the spring 24, the lugs 22 contact the upper side wall 40 of the helical slot 38. This thereby produces the requisite torque while the lipstick is being extended. Similarly, when the cosmetic carrier 16 end, hence, the lipstick 12, is being retracted, the base 62 is rotated in the opposite direction wherein the cosmetic carrier traverses the length of the helical slot downward wherein the movement of the cosmetic carrier 16 is countered to the bias of the biasing member 24 wherein, again, torque is created.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A cosmetic container comprising:

a tubular outer sleeve including a helical channel extending along an inner periphery thereof;

a base positioned concentrically around said tubular outer sleeve so as to coaxially surround at least a bottom portion of said outer sleeve and being rotatably associated with said tubular outer sleeve;

a collar which extends circumferentially around said base and only a portion of said outer sleeve;

a cosmetic carrier positioned within said outer sleeve and being movable longitudinally upwardly or downwardly within said outer sleeve; and a biasing member connected at a proximal end to said cosmetic carrier and at a distal end to said base to substantially limit relative rotational movement between said cosmetic carrier and said base and to urge said cosmetic carrier away from said base.

2. A cosmetic container according to claim 1 wherein said biasing member is a spring.

3. A cosmetic container according to claim 1 wherein said cosmetic carrier has a bottom and cylindrical sidewalls extending upwardly from said bottom to define a cup for receiving and holding a cosmetic, said proximal end of said biasing member being connected to an underside of said bottom of said carrier for biasing the cosmetic carrier upward from said base.

4. A cosmetic container according to claim 3 wherein said underside of said carrier bottom defines a seat, and said proximal end of said biasing member is secured to said seat.

5. A cosmetic carrier according to claim 4 wherein said biasing member is a helical spring, and said seat is a groove for receiving said proximal end of said spring to substantially prevent relative rotational movement between said spring and said cosmetic carrier.

6. A cosmetic container according to claim 4 wherein said base defines a seat, and said distal end of said biasing member is secured to said seat.

7. A cosmetic container according to claim 6 wherein said biasing member is a helical spring and said seat is a groove for receiving said distal end of said spring to substantially prevent relative rotational movement between said distal end of said spring and said base.

8. A cosmetic container according to claim 1 wherein said cosmetic carrier includes at least one lug extending radially outwardly from said cosmetic carrier wherein at least a portion of said lug is received in said helical channel of said outer sleeve so that upon rotation of said base, said cosmetic carrier will be propelled longitudinally upwardly or downwardly within said outer sleeve.

* * * * *